US012768235B2

(12) United States Patent
Haugen et al.

(10) Patent No.: US 12,768,235 B2
(45) Date of Patent: Oct. 20, 2026

(54) BAND BASKETS AND RELATED METHODS

(71) Applicant: Legacy Tool and Rental LLC, Watford City, ND (US)

(72) Inventors: Dylan Haugen, Dickinson, ND (US); Corey Ollerman, Glendive, MT (US)

( * ) Notice: Subject to any disclaimer, the term of this patent is extended or adjusted under 35 U.S.C. 154(b) by 0 days.

(21) Appl. No.: 18/676,222

(22) Filed: May 28, 2024

(65) Prior Publication Data

US 2024/0392643 A1 Nov. 28, 2024

Related U.S. Application Data

(60) Provisional application No. 63/469,007, filed on May 25, 2023.

(51) Int. Cl.
*E21B 27/00* (2006.01)

(52) U.S. Cl.
CPC ..... *E21B 27/00* (2013.01)

(58) Field of Classification Search
None
See application file for complete search history.

(56) References Cited

U.S. PATENT DOCUMENTS 2,663,370 A * 12/1953 Donnell ..... E21B 27/005 166/99
2,670,930 A * 3/1954 Farrar ..... E21B 27/00 166/99
2,993,539 A * 7/1961 Baker ..... E21B 37/00 166/99
5,029,643 A * 7/1991 Winslow ..... E21B 33/1291 166/131
2014/0202699 A1* 7/2014 Loving ..... E21B 43/086 166/99
2016/0160596 A1* 6/2016 Malafey ..... E21B 23/0411 166/99
2020/0131874 A1* 4/2020 Cajiles ..... E21B 33/12
2020/0378205 A1* 12/2020 Clemens ..... E21B 23/00
2021/0372214 A1* 12/2021 Alarfaj ..... E21B 27/005

* cited by examiner

*Primary Examiner* — Kipp C Wallace

(57) ABSTRACT

Band baskets and methods of using the band baskets on a bottom hole assembly (BHA) to remove debris from a borehole are disclosed. An exemplary band basket comprises a basket having an inner wall, an outer wall, and a plurality of radial holes connecting the inner wall and the outer wall and a bushing attached to a bottom end of the basket. A gauge ring may be attached to a top end of the basket, and, when a mandrel of the BHA runs through the band basket, the bottom end of the basket is sealed by the bushing and the top end of the basket is open to receive debris from above.

18 Claims, 12 Drawing Sheets

BAND BASKETS AND RELATED METHODS

CLAIM OF PRIORITY

This application claims priority to and the benefit of U.S. Provisional Application No. 63/469,007, filed May 25, 2023, titled "BAND BASKETS AND RELATED METHODS," the entirety of which is hereby incorporated by reference.

BACKGROUND

In geological drilling operations, releasable packers are used in wellbore formation and completion. For example, U.S. Pat. No. 5,197,547 describes an example of a downhole packer comprising a mandrel having a longitudinal bore; a packer, supported on the mandrel, having radially expandable elements; a spring cage, having releasable slips, above the packer; and a sub, having a J slot providing for extension and retraction of lugs, below the packer. Additional tools may be provided on either end of this type of bottom-hole assembly ("BHA").

During use of a packer, various types of debris, including rocks, tools, and other items may fall down the wellbore. This debris may interfere with the wellbore formation, disrupt packer extraction, and otherwise disturb operations. Current technology to catch such debris includes a junk catcher that has spring loaded arms, which can be placed above the spring cage to catch debris that falls downhole before it clogs the casing and/or impedes moveable parts, thereby facilitating retrieval of the BHA. U.S. Pat. No. 8,978,752 discloses a band basket catcher having a series of upwardly directed spring-tensioned blades attached to a collar that clamps onto an outer wall of a tubing. A similar device, for attachment to a sucker rod of a water well, is described in U.S. Pat. No. 1,880,004. The device described in U.S. Pat. No. 1,880,004 has a threaded base that screws onto a two-part collar surrounding an enlarged ring of the sucker rod.

One problem with these types of devices is that their flexible blades can break or deform, and potentially catch on debris and physical irregularities along a casing wall. In addition, the connectors joining the devices and tubing are subject to failure under the significant forces that are sometimes necessary to remove a BHA.

It is with respect to these and other considerations that the technologies described below have been developed. Also, although relatively specific problems have been discussed, it should be understood that the examples provided herein should not be limited to solving the specific problems identified in the introduction.

Band Baskets and Related Methods

The present disclosure generally relates to band baskets coupled to a packer for catching and collecting debris dropped down a borehole of a well, and methods for using the same. Aspects of the present technology include catch-baskets that are rigid, static, and non-elastically deformable. In aspects, the innovative band basket is generally closed at a bottom end (e.g., an end toward the bottom of the well) so as to catch debris and open at a top end so as to allow the debris to fall into the body of the basket. The relative rigidity of the devices helps ensures that debris caught in or near a casing wall or physical irregularities within the casing wall are sheared clean by the band basket, thereby providing a relatively unobstructed path for the packer. In additional/alternative aspects of the technology, the disclosed band baskets have a bushing at a bottom end of the basket that directly connects the basket to a spring cage, such that the bushing serves the same or similar functions of a traditional spring cage cap. The bushing, however, in some examples is able to withstand relatively high compressive forces.

In some examples of the technology, the bushing and, optionally a gauge ring, which may be attached to a top of the band basket, are removable such that a person in the field can select and implement an appropriate diameter of the bushing and/or gauge ring for a given casing diameter.

In additional/alternative examples, a band basket for use on a bottom hole assembly ("BHA") in a borehole of a well comprises a basket having an inner wall, an outer wall, and a plurality of radial holes connecting the inner wall and the outer wall and a bushing attached to a bottom end of the basket.

In examples, the band basket has a non-deformable structure and does not include baffles. The bushing may be a removable bushing, which may, for example, be attached to a basket having a retaining groove for receiving a set screw. In an example, the body of the band basket includes one or more perforations and/or slots such that liquid may pass out of the body of the band basket. In examples, a basket is a straight-walled cylinder comprising at least one retaining groove for receiving a set screw of a removable bushing.

In examples, the bushing is a female-to-female bushing, which may be internally threaded or unthreaded. In further examples, the bushing further comprises an internal flange, such as an internal flange separating the female ends of a female-to-female bushing. In an example, an end of a basket abuts one side of the internal flange and an end of a spring cage abuts the other side of the internal flange. For example, the bushing may replace a spring cage cap of a traditional spring cage.

In examples, a band basket further comprises a gauge ring attached to a top end of the basket. The gauge ring may, in some embodiments, have a tapered top end that helps to direct debris into the band basket. In an embodiment, the gauge ring is a removable gauge ring, which may, for example, be attached to a basket having a retaining groove for receiving a set screw.

In examples, the basket is a straight-walled cylinder comprising at least one retaining groove for receiving a set screw of the gauge ring. In additional/alternative examples, a basket comprises a pair of retaining grooves at opposite ends of the basket for receiving set screws of a removable bushing and a removable gauge ring.

In examples, a basket is disposed on a mandrel of a bottom hole assembly (BHA) such that an annular space exists between the inner wall of the basket and an external wall of the mandrel. In such examples, the annular space may be relatively sealed at the bottom end of the basket by the bushing such that debris cannot readily pass through the bottom end of the basket. This, for example, contrasts with the annular space being relatively open at the top end of the basket. In examples, the band basket is fixedly positioned relative to the mandrel.

Examples also include a bushing directly connected to the basket and a spring cage of the BHA, such that the band basket is fixedly positioned. For example, the bushing may be removably attached to the spring cage or welded to the spring cage. In some examples, the band basket is fixedly positioned relative to the spring cage.

In an aspect, a method of collecting debris from a well bore comprises connecting a band basket having a basket including an inner wall, an outer wall, and a plurality of radial holes connecting the inner wall and the outer wall and a bushing attached to a bottom end of the basket to a BHA and removing the band basket from the well bore. Coupling the band basket to the BHA may include running a mandrel annularly through the bushing and the basket such that an annular space exists between the inner wall of the basket and an external wall of the mandrel (e.g., a pup joint of the BHA), such that the annular space prevents some or all debris from moving past the bushing. In an example, connecting the band basket to the BHA comprises attaching a spring cage directly to the bushing.

It is to be understood that both the foregoing introduction and the following detailed description are exemplary and explanatory and are intended to provide further explanation of the innovative technologies as claimed.

BRIEF DESCRIPTION OF THE DRAWINGS

Illustrative embodiments of the present invention are described in detail below with reference to the attached drawings, wherein.

DETAILED DESCRIPTION

In general, the terms and phrases used herein have their art-recognized meaning, which can be found by reference to standard texts, journal references and contexts known to those skilled in the art. The following definitions are provided to clarify their specific use in the context of this description.

A "device" is a combination of components operably connected to produce one or more desired functions.

A "component" is used broadly to refer to an individual part of a device.

A "bushing" refers to a fixed or removable cylindrical metal sleeve used to join and reinforce end portions of cylindrical components.

As used herein, a "longitudinal dimension" is the longest dimension of a device or component, and a lateral dimension is perpendicular to the longitudinal dimension. A lateral dimension is typically a cross section of the longitudinal dimension.

"Integral" refers to items or components that are unitary in structure. For example, unitary items or components may be formed as a single structure or unitary body. Items or components that are not integral or unitary form at least two distinct structures that are separate or easily separated from one another.

As used herein, "non-deformable" refers to rigidity or physical inflexibility that maintains a structure of an object as relatively static under certain pressures. For example, a non-deformable steel object is not bendable, compressible or breakable under relatively high pressures, e.g., between 10,000 psi and 35,000 psi.

"Proximal" and "distal" refer to the relative positions of two or more objects, planes or surfaces. For example, an object that is close in space to a reference point relative to the position of another object is considered proximal to the reference point, whereas an object that is further away in space from a reference point relative to the position of another object is considered distal to the reference point.

The terms "direct and indirect" describe the actions or physical positions of one object relative to another object. For example, an object that "directly" acts upon or touches another object does so without intervention from an intermediary. Contrarily, an object that "indirectly" acts upon or touches another object does so through an intermediary (e.g., a third component).

Figure 1:
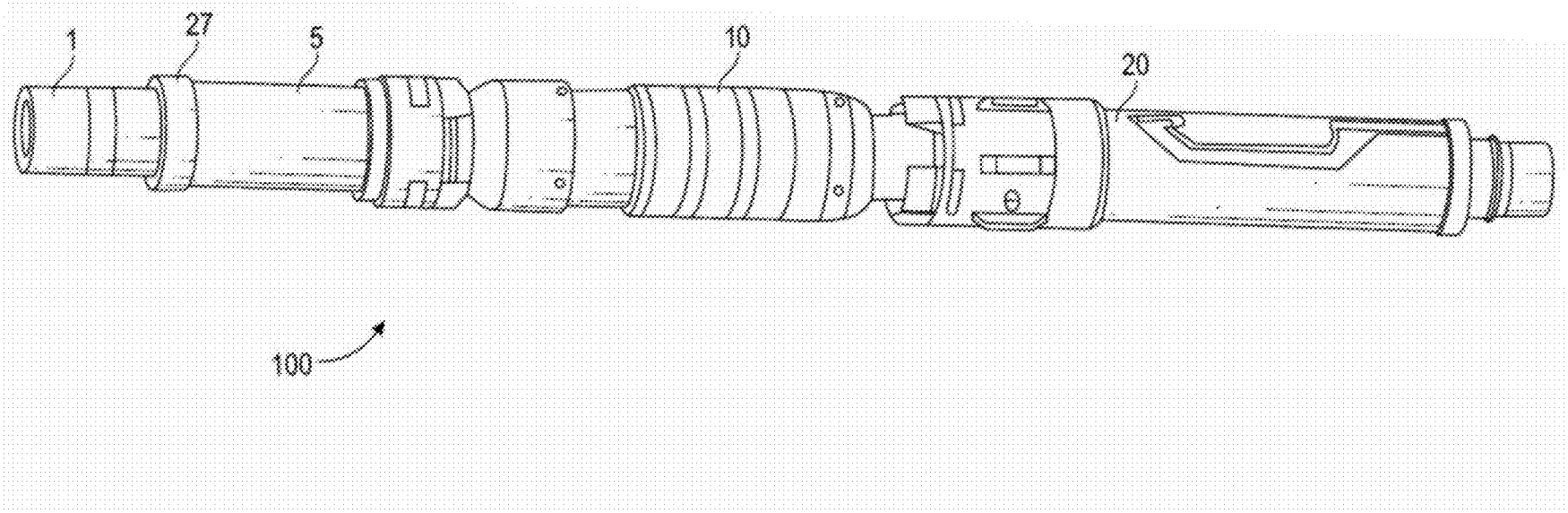
FIG. 1 PRIOR ART
FIG. 1 is a schematic of a bottom hole assembly (BHA) comprising a spring cage, a packer, and a J slot sub.
Figure 2:
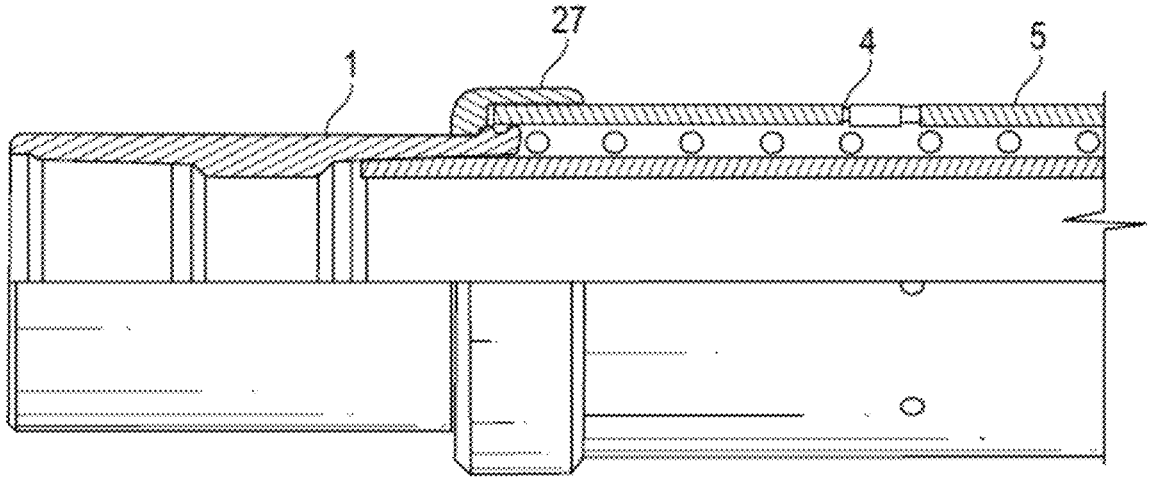
FIG. 2 PRIOR ART
FIG. 2 is a cutaway detailed view of the spring cage cap area of the BHA of FIG. 1.

FIG. 1 is a schematic of a bottom hole assembly (BHA) 100 comprising a spring cage 5, which, in examples, houses and protects springs while ensuring they function correctly. Additionally illustrated is a packer 10, and a J-slot bottom sub 20. J-slot bottom sub 20, in examples, is used to control the setting and releasing actions through a J-shaped slot mechanism that interacts with a corresponding lug or pin. Each of these components may have one or more attachment elements, such as slips, lugs, or expandable rubber elements, that physically contact a well casing to hold the BHA in place within the well bore. In the case of a retrievable packer, the attachment elements retract or break away to allow for removal of the BHA from the well bore. As shown, spring cage 5 is attached to an upper sub 1 by a spring cage cap 27. FIG. 2 is a cutaway detailed view of the spring cage cap area of BHA 100 of FIG. 1. The spring cage cap 27 overlaps an external flange on upper sub 1 and is removably coupled via a thread onto a male end of spring cage 5. A mandrel 4 is, in examples, concentrically disposed throughout the BHA. In examples, the mandrel 4 is the central cylindrical rod that provides structural support and alignment for the tool's components. It may serve as a conduit for the passage of fluids while aiding the packer's elements, such as sealing mechanisms and slips, to be properly positioned and function effectively.

Figure 3:
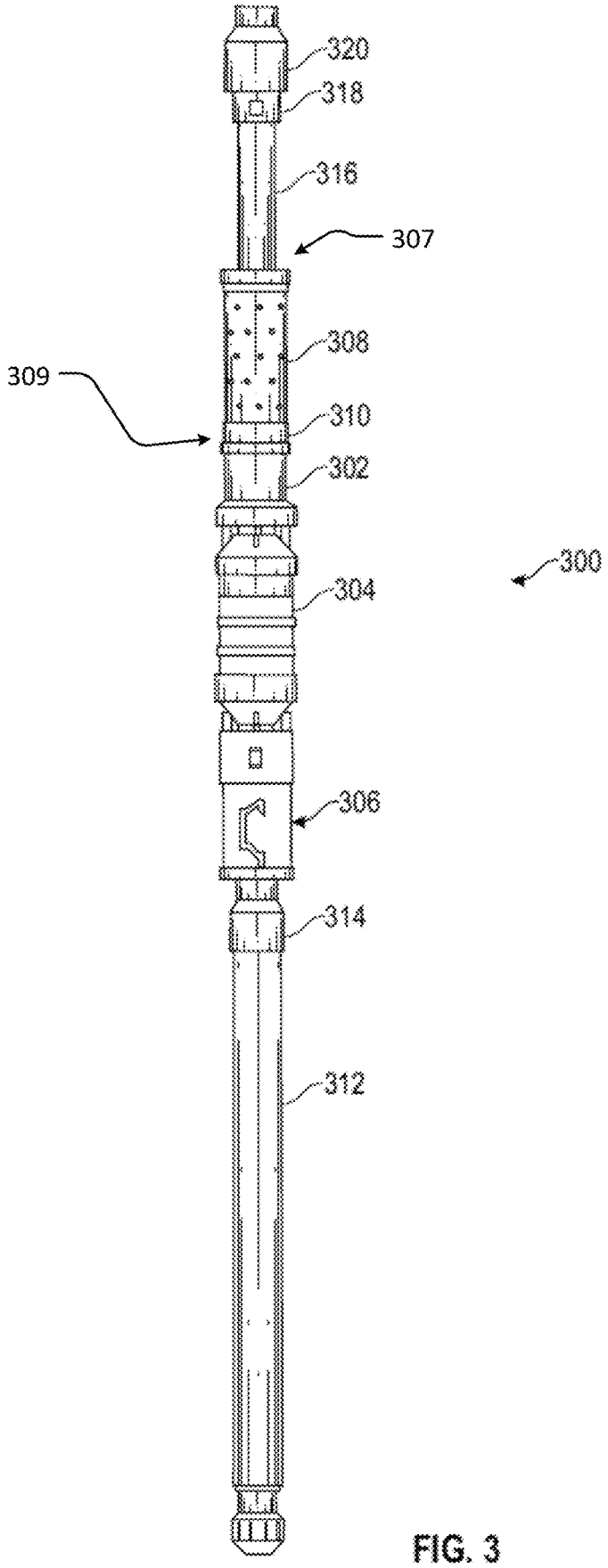
FIG. 3 illustrates a BHA including a band basket, according to an embodiment.

FIG. 3 illustrates an example BHA 300 including a band basket 308. As illustrated, the band basket 308 is coupled to the spring cage 302 via a bushing 310. The band basket 308, in examples, is oriented such that an opening of the band basket 308 is positioned to receive falling objects from the top of the wellbore. In additional/alternative examples, the band basket 308 comprises a relatively rigid material (e.g., steel). The relative rigidity of the devices helps promote the band basket shearing debris or physical irregularities that may be present along a casing wall. Having a relatively rigid band basket 308, for certain applications, helps promote a relatively unobstructed path for the packer than would otherwise be there with other technologies (e.g., one or more spring-tensioned blade).

Additionally illustrated is a spring cage 302, a retrievable packer 304, and a J slot bottom sub 306. In addition, a band basket 308, according to an example of the present disclosure, is coupled to the spring cage 302 by a bushing 310, which is described in further detail below. In examples, the bushing 310 performs some or all of the functions of the traditional spring cage cap, such as the spring cage cap 27 illustrated in FIGS. 1 and 2. The bushing 310, seals against the tubing 316, or other part of the BGH (e.g., a mandrel or spring cage) such that an inner annular opening is small enough to not readily allow debris or tools to fall through. That is, the top annular opening 307 allows debris to fall in, but the bottom of the cage 309 has a smaller annular opening than the top of the band basket 308 because the bushing seals over an adjacent part (as illustrated, the spring cage 302).

Additional devices and equipment are illustrated in FIG. 3, though need not be present. For example, various elastomers 304 are part of the illustrated BHA 300, as is a j-body 306, and a desander 314. The desander 314 may serve to improve drilling efficiency and protect equipment, among other features. Additionally illustrated is a tail joint 312, which may be used to provide weight on bit, drilling fluid circulation, and stabilization, in examples. Further, an on/off tool 320 and a seat nipple 318 are also present. Other components of a BHA, such as a No-Go, mud joint, and other components, may also be present on BHAs where a band basket of the present disclosure may also be present.

Figure 4A:
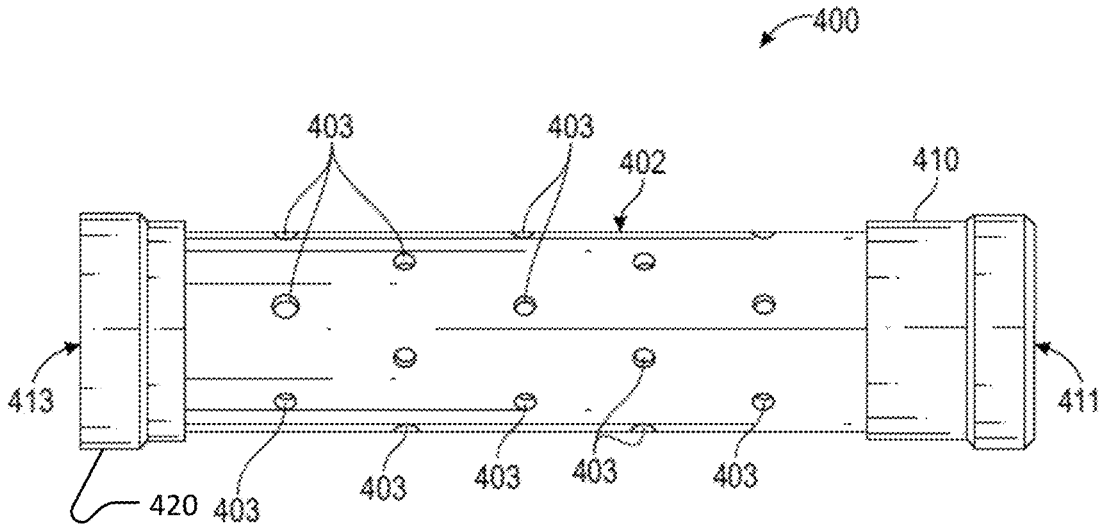
FIGS. 4A-C illustrate a schematic of a band basket, according to an embodiment.
Figure 4B:
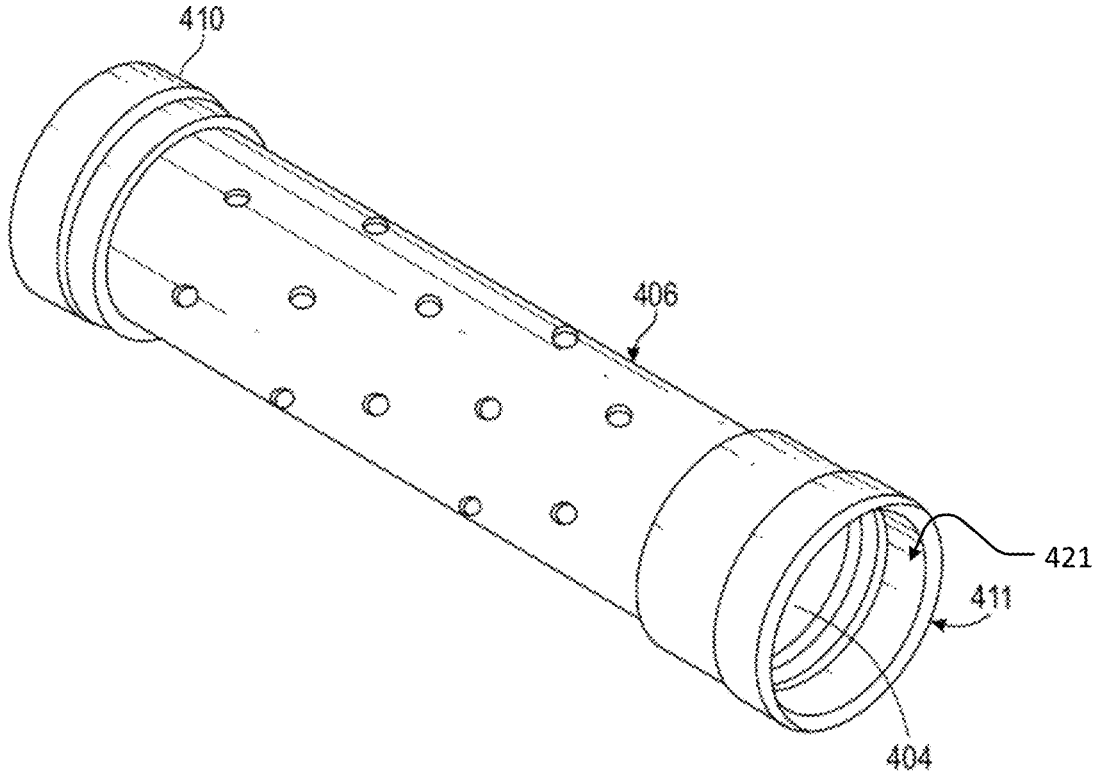
Figure 4C:
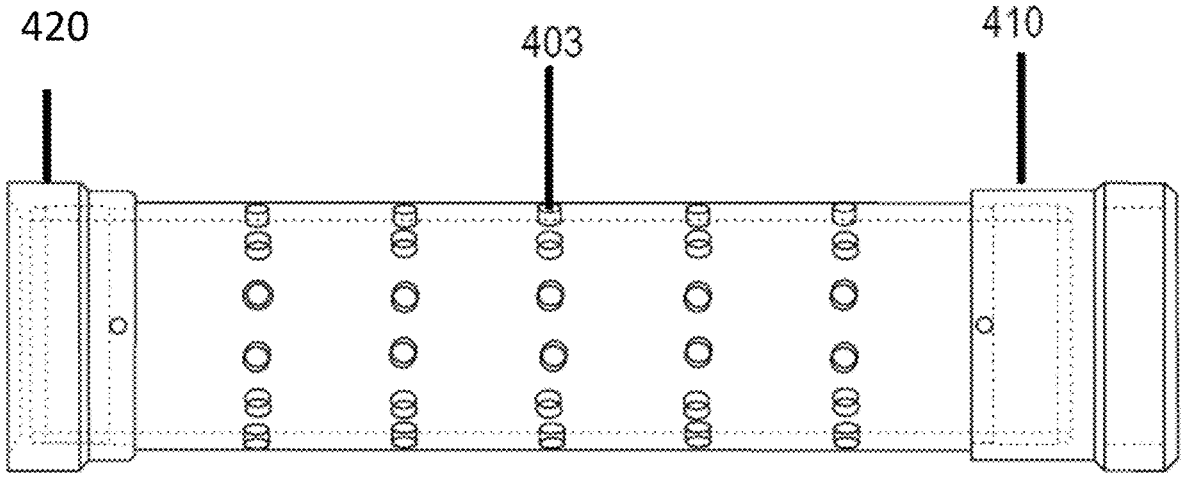

FIGS. 4A-C illustrate a band basket 400, according to an embodiment of the present disclosure. As illustrated, band basket 400 comprises a basket 402, which may be a perforated, straight-walled cylinder, having an inner wall 404, an outer wall 406, and a plurality of radial holes 408 passing from the inner wall 404 to the outer wall 406. As shown in FIG. 4, basket 402 is coupled to a bushing 410 at a bottom end 411, and a gauge ring 420 at a top end 413. As illustrated, the bushing 410 is a female-female bushing, and the bushing 410 receives the bottom end of the band basket 411. Additionally, the top end 413 of the band basket 400 is inserted into the gage ring 420.

Figure 10:
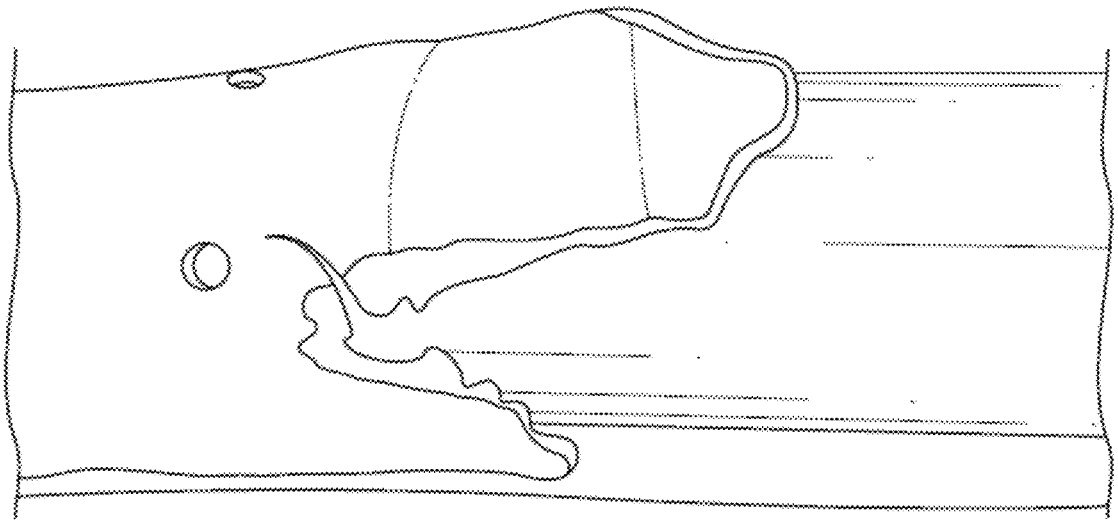
FIG. 10 illustrates damage to a band basket lacking a bushing, which may occur during extraction.

Aspects of the technology include using various types of coupling devices to couple a band basket to one or more elements of a BHA. For example, a bushing having a male end may be inserted into basket 402 and further joined with neighboring components, such as the spring cage illustrated above. For some applications, however, a female opening slotted over the outer wall 406 inhibits potential failure. FIG. 10 illustrates an example of a male coupling arrangement, which failed during extraction. Thus, a first end of a band basket inserted into a female bushing aids in the band basket 406 being relatively non-deformable for some applications.

As illustrated, bushing 410 attaches to a bottom end 411 of basket 402. In operation, the busing may seal the bottom end 411 between an outer wall of a mandrel running longitudinally through the basket and the inner wall of the basket and or the inner wall 421 of the bushing. Bushing 410 may be a removable bushing attached to basket 402. For example, a set screw may engage a retaining groove of the outer wall of a band basket. Alternatively, bushing 410 may be non-removable and, for example, may be welded to basket 402. As shown, bushing 410 is a female-to-female connector, which may be threaded or unthreaded. In examples where the bushing is threaded, corresponding threads may be present on one or more of the band basket 402 and/or other elements, such as a spring cage and/or mandrel.

Figure 5A:
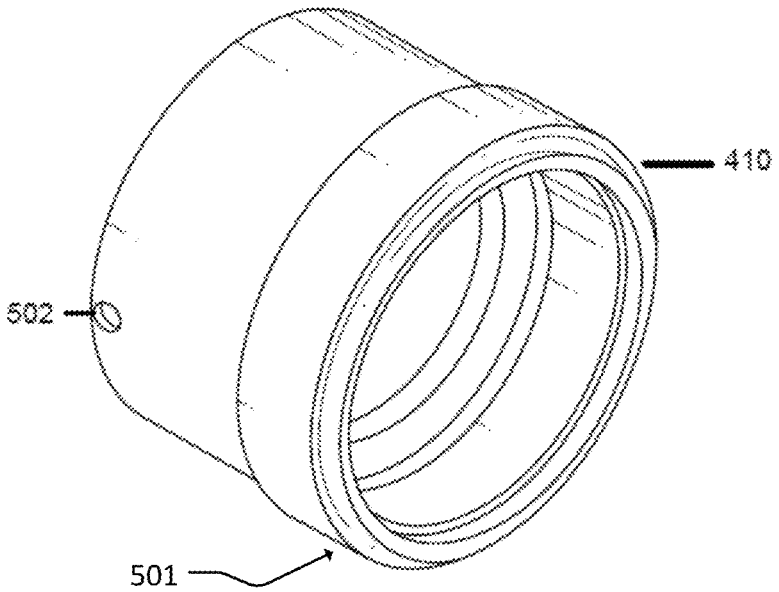
FIGS. 5A-B illustrate details of the bushing shown in FIG. 4.
Figure 5B:
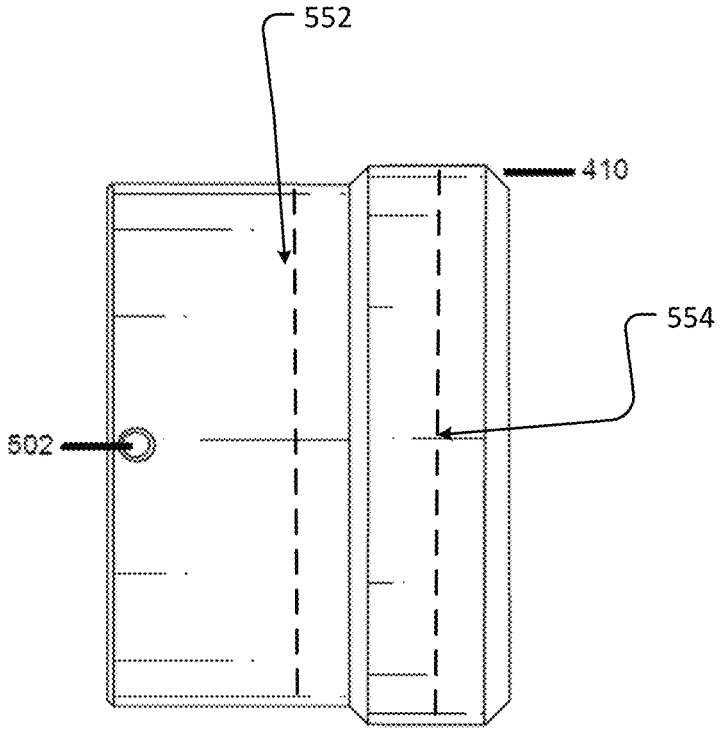
Figure 8A:
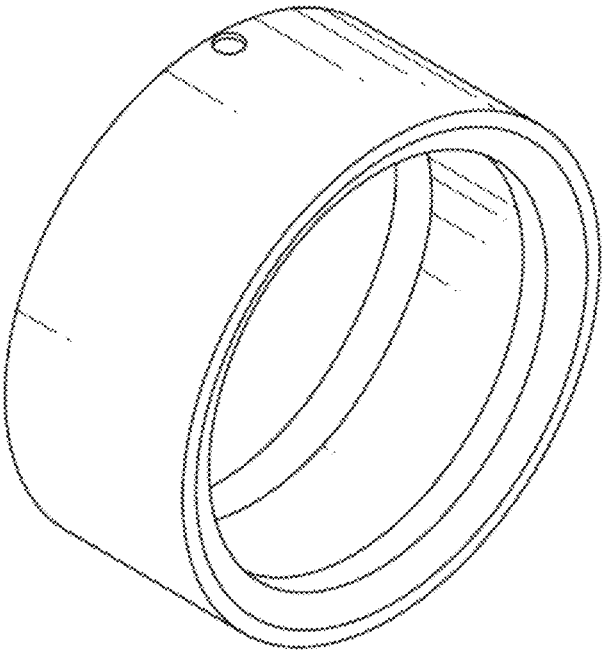
FIGS. 8A-B illustrates details of the bushing shown in FIG. 7.
Figure 8B:
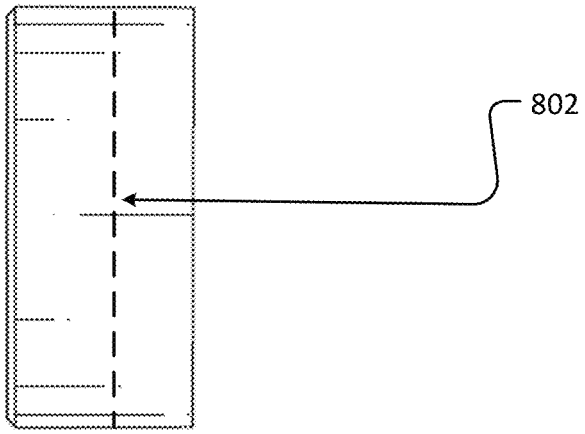

FIGS. 5A-C illustrates details of a bushing 410 shown in FIG. 4. As illustrated, bushing 410 comprises an internal flange 501, which allows two components with different diameters to be joined. For example, the bushing may couple a bottom end of a band basket to a mandrel, a spring cage, a tubing, a piping, and the like. Such coupling may result in a bottom basket being relatively sealed such that debris is deterred from falling out of the bottom of the basket. As shown, bushing 410 has at least two outer diameters, a first diameter 552 and a second diameter 554, which may, for example, reduce material relative to a bushing having a single outer diameter (such as the single outer diameter 802 illustrated in FIGS. 8A-B), but a single outer diameter may provide for greater structural reinforcement in some examples. As shown, bushing 410 includes an optional recessed hole 502 for a set screw.

Figure 6A:
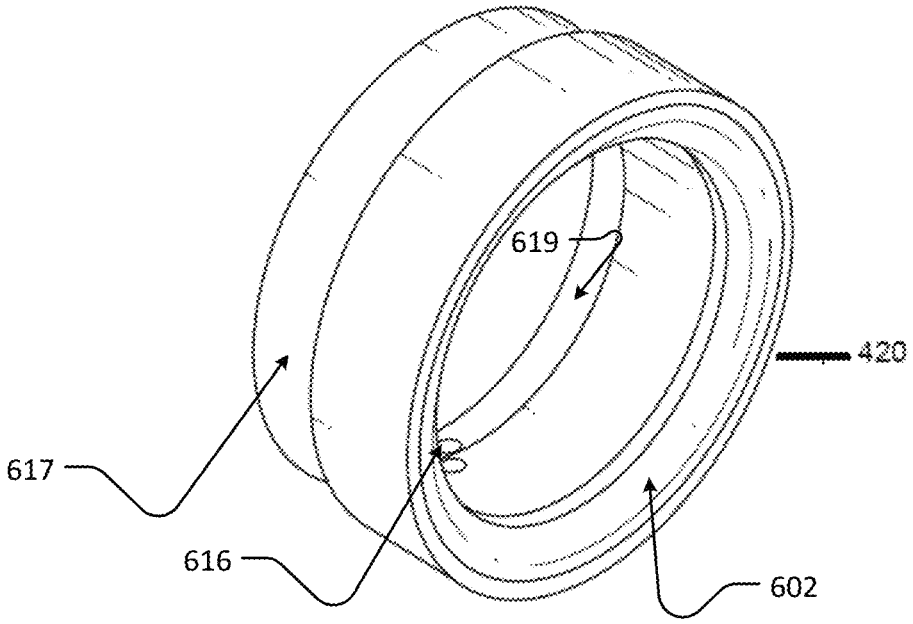
FIGS. 6A-B illustrate details of the gauge ring shown in FIG. 4.
Figure 6B:
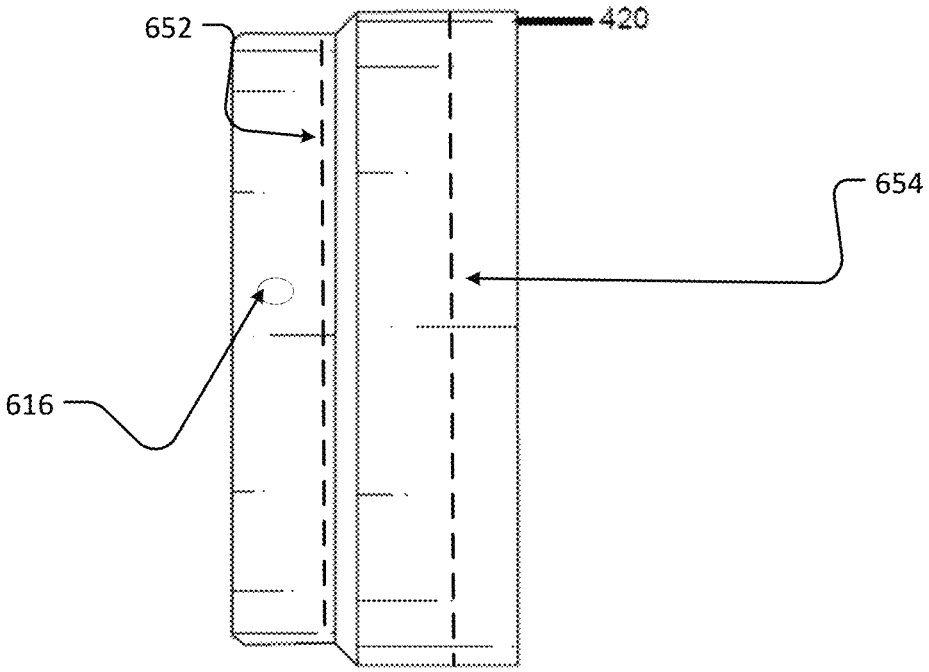

FIGS. 6A-B illustrates details of gauge ring 420 shown in FIG. 4. Gauge ring 420 attaches to a top end 412 of a band basket 402. For example, gauge ring 420 may be a removable gauge ring attached to basket 402 by a set screw that engages a retaining groove 616 in the outer wall 406 of basket 402. Alternatively, gauge ring 420 may be non-removable and, for example, welded to basket 402. Removability of bushing 410 and/or gauge ring 420 allows, in certain applications, adjustments based on bore diameter to be made in the field.

Figure 7A:
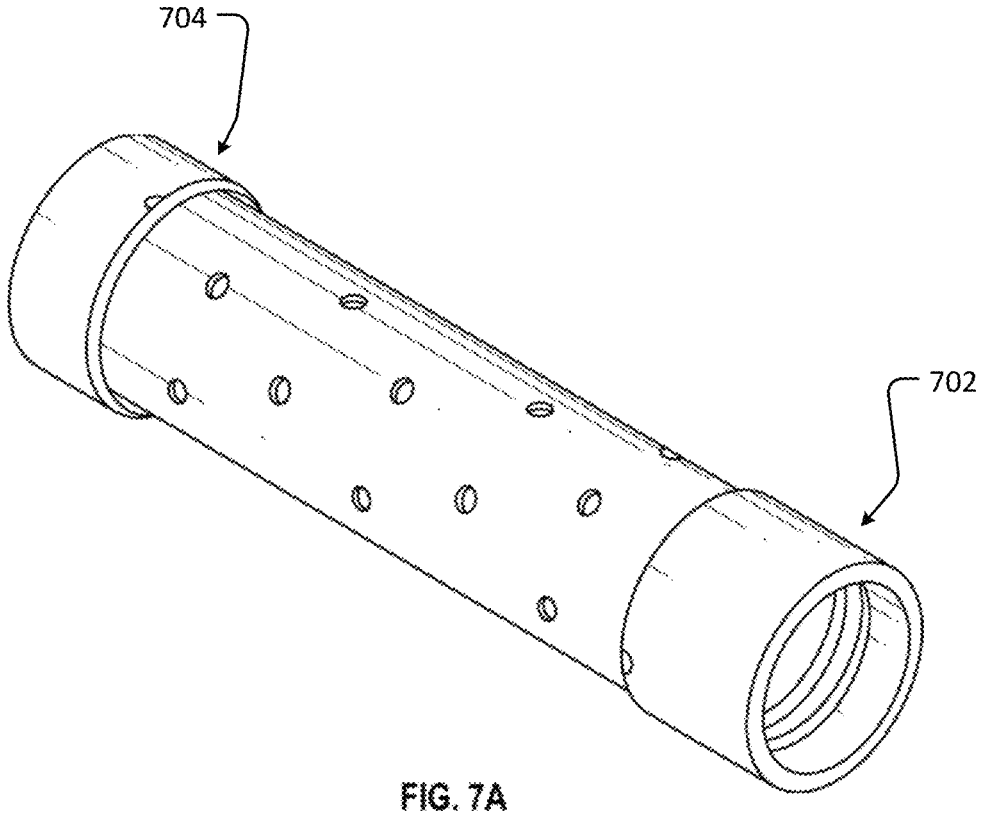
FIGS. 7A-C illustrate an example schematic of a band basket.
Figure 7B:
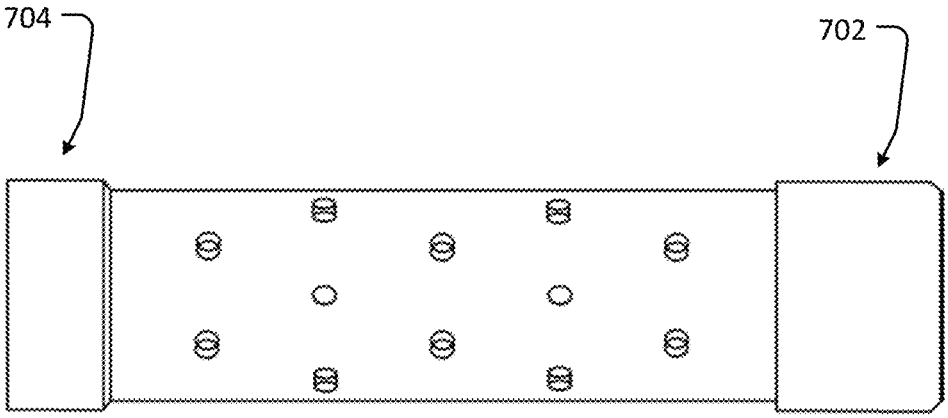
Figure 7C:
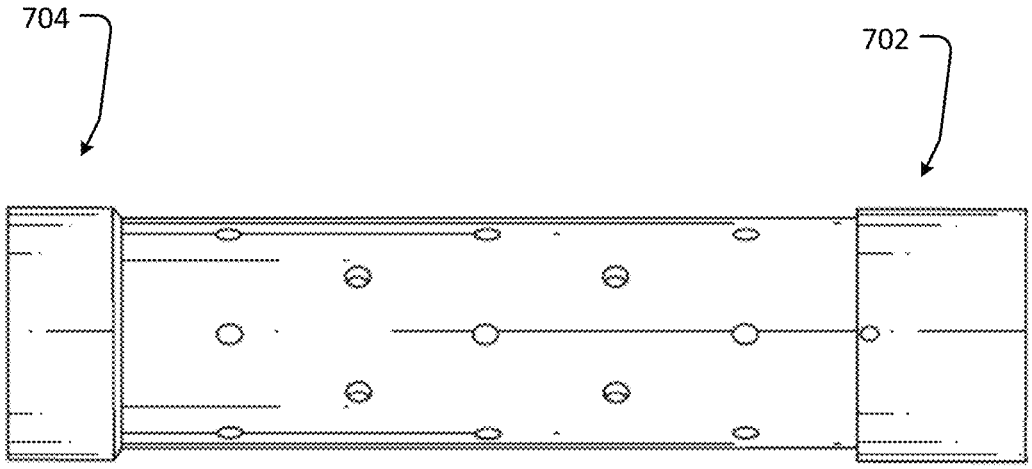
Figure 9A:
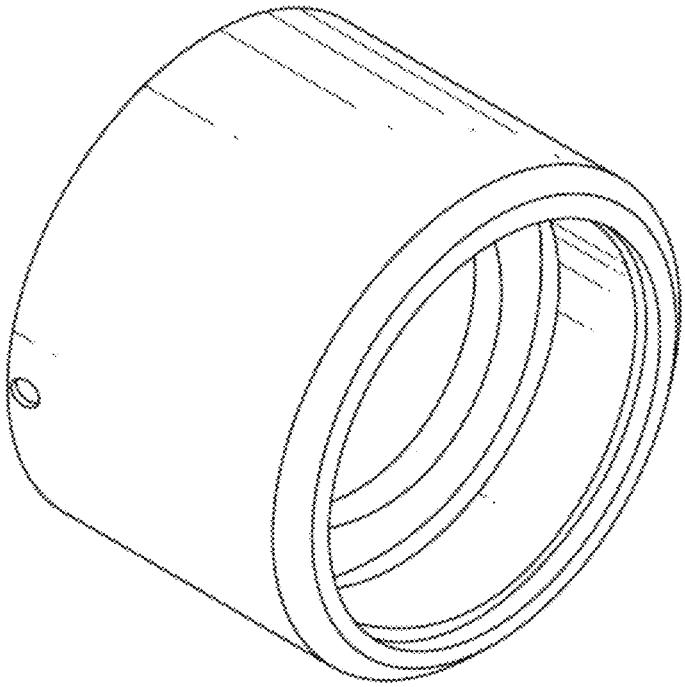
FIGS. 9A-B illustrates details of the gauge ring shown in FIG. 7.
Figure 9B:
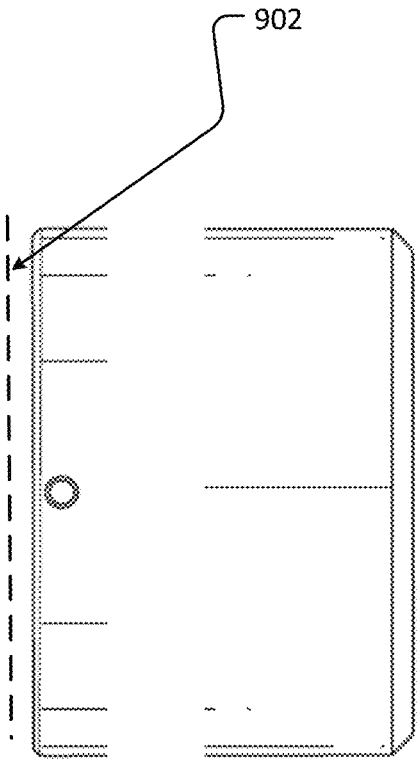

As shown, gauge ring 420 is a female connector, which may be threaded or unthreaded. A top surface 602 of gauge ring 420 may be angled or beveled toward an interior of the gauge ring to encourage debris to enter the band basket, which is open at the top into an annular space formed by a mandrel or tubing and the inner wall of the basket. As shown, gauge ring 420 includes an optional recessed hole 616 for a set screw. As shown, gauge ring 420 has at least two outer diameters, a first outer diameter 652 and a second outer diameter 654, which may, for example, reduce material relative to a gauge ring having a single outer diameter (such as the single outer diameter 902 illustrated in FIGS. 9A-B), but a single outer diameter may provide greater reinforcement and/or reduce manufacturing complexity in certain applications. FIG. 7A-C show an example of a band basket having a bushing and a gauge ring that both have a single outer diameter. However, use of one connector (bushing, gauge ring) having multiple outer diameters and one connector having a single outer diameter is also contemplated.

STATEMENTS REGARDING INCORPORATION BY REFERENCE AND VARIATIONS

All references cited throughout this application, for example patent documents including issued or granted patents or equivalents; patent application publications; and non-patent literature documents or other source material; are hereby incorporated by reference herein in their entireties, as though individually incorporated by reference, to the extent each reference is at least partially not inconsistent with the disclosure in this application (for example, a reference that is partially inconsistent is incorporated by reference except for the partially inconsistent portion of the reference).

The terms and expressions which have been employed herein are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the invention has been specifically disclosed by preferred embodiments, exemplary embodiments and optional features, modification and variation of the concepts herein disclosed can be resorted to by those skilled in the art, and that such modifications and variations are considered to be within the scope of this invention as defined by the appended claims. The specific embodiments provided herein are examples of useful embodiments of the invention and it will be apparent to one skilled in the art that the invention can be carried out using a large number of variations of the devices, device components, and method steps set forth in the present description. As will be apparent to one of skill in the art, methods and devices useful for the present methods and devices can include a large number of optional composition and processing elements and steps. All art-known functional equivalents of materials and methods are intended to be included in this disclosure. Nothing herein is to be construed as an admission that the invention is not entitled to antedate such disclosure by virtue of prior invention.

When a group of substituents is disclosed herein, it is understood that all individual members of that group and all subgroups are disclosed separately. When a Markush group or other grouping is used herein, all individual members of the group and all combinations and subcombinations possible of the group are intended to be individually included in the disclosure.

It must be noted that as used herein and in the appended claims, the singular forms "a", "an", and "the" include plural reference unless the context clearly dictates otherwise. Thus, for example, reference to "a fastener" includes a plurality of such fasteners and equivalents thereof known to those skilled in the art, and so forth. As well, the terms "a" (or "an"), "one or more" and "at least one" can be used interchangeably herein. It is also to be noted that the terms "comprising", "including", and "having" can be used interchangeably. The expression "of any of claims XX-YY" (wherein XX and YY refer to claim numbers) is intended to provide a multiple dependent claim in the alternative form, and in some embodiments is interchangeable with the expression "as in any one of claims XX-YY."

Unless defined otherwise, all technical and scientific terms used herein have the same meanings as commonly understood by one of ordinary skill in the art to which this invention belongs. Although any methods and materials similar or equivalent to those described herein can be used in the practice or testing of the present invention, the preferred methods and materials are described.

Whenever a range is given in the specification, for example, a range of integers, a temperature range, a time range, a composition range, or concentration range, all intermediate ranges and subranges, as well as all individual values included in the ranges given are intended to be included in the disclosure. As used herein, ranges specifically include the values provided as endpoint values of the range. As used herein, ranges specifically include all the integer values of the range. For example, a range of 1 to 100 specifically includes the end point values of 1 and 100. It will be understood that any subranges or individual values in a range or subrange that are included in the description herein can be excluded from the claims herein.

As used herein, "comprising" is synonymous and can be used interchangeably with "including," "containing," or "characterized by," and is inclusive or open-ended and does not exclude additional, unrecited elements or method steps. As used herein, "consisting of" excludes any element, step, or ingredient not specified in the claim element. As used herein, "consisting essentially of" does not exclude materials or steps that do not materially affect the basic and novel characteristics of the claim. In each instance herein any of the terms "comprising", "consisting essentially of" and "consisting of" can be replaced with either of the other two terms. The invention illustratively described herein suitably can be practiced in the absence of any element or elements, limitation or limitations which is/are not specifically disclosed herein.

What is claimed is:

1. A band basket for use on a bottom hole assembly (BHA) in a borehole of a well, the band basket comprising:

a basket having an inner wall, an outer wall, a plurality of radial holes connecting the inner wall and the outer wall, and an annular opening at a top end of the basket opposite a bottom end, wherein the bottom end is more proximate to a spring cage of a packer or plug than the top end, wherein the basket is disposed on a mandrel of the BHA such that an annular space exists between the inner wall of the basket and an external wall of the mandrel; and a bushing attached to the bottom end of the basket, the bushing sealing the annular space at the bottom end of the basket and connecting the basket to the spring cage above the packer or plug, wherein the basket is configured to allow debris to enter the basket through the annular opening and into the annular space when the basket is being lowered into and retrieved from the well.

2. The band basket of claim 1, having a non-deformable structure.

3. The band basket of claim 1, wherein the bushing is a removable bushing.

4. The band basket of claim 3, wherein the basket is a straight walled cylinder comprising at least one retaining groove for receiving a set screw of the removable bushing.

5. The band basket of claim 1, wherein the bushing is a female-to-female bushing.

6. The band basket of claim 5, wherein the bushing is a female-to-female unthreaded bushing.

7. The band basket of claim 5, wherein the bushing further comprises an internal flange.

8. The band basket of claim 1, further comprising a gauge ring attached to the top end of the basket.

9. The band basket of claim 8, wherein the gauge ring is a removable gauge ring.

10. The band basket of claim 9, wherein the basket is a straight walled cylinder comprising at least one retaining groove for receiving a set screw of the gauge ring.

11. The band basket of claim 1, wherein the annular space is sealed at the bottom end of the basket by the bushing.

12. The band basket of claim 1, wherein the annular space is open at the top end of the basket.

13. The band basket of claim 1, wherein the band basket is fixedly positioned relative to the mandrel.

14. The band basket of claim 1, wherein the bushing directly connects the basket and the spring cage of the BHA.

15. A method of collecting debris from a well bore, the method comprising:

connecting a band basket to a bottom hole assembly (BHA), wherein the band basket comprises:

a basket having an inner wall, an outer wall, a plurality of radial holes connecting the inner wall and the outer wall, and an annular opening at a top end of the basket opposite a bottom end, wherein the bottom end is more proximate to a spring cage of a packer or plug than the top end, wherein the annular opening is configured to allow debris to enter the basket when the BHA is in the well bore; and a bushing attached to the bottom end of the basket;

wherein the basket is disposed on a mandrel of the BHA such that an annular space exists between the inner wall of the basket and an external wall of the mandrel, the bushing sealing the annular space at the bottom end of the basket and connecting the basket to the spring cage above the packer or plug;

lowering the band basket into the well bore, and removing the band basket from the well bore, wherein debris is allowed to enter the basket through the annular opening and into the annular space during the lowering and removing.

16. The method of claim 15, wherein the band basket further comprises a gauge ring attached to the top end of the basket.

17. The method of claim 15, wherein the annular space is open at the top end of the basket.

18. The method of claim 15, wherein connecting the band basket to the BHA comprises attaching the spring cage directly to the bushing.

* * * * *